US006842159B2

(12) United States Patent
Kishi et al.

(10) Patent No.: US 6,842,159 B2
(45) Date of Patent: Jan. 11, 2005

(54) PLASMA DISPLAY APPARATUS

(75) Inventors: Tomokatsu Kishi, Kawasaki (JP); Yoshikazu Kanazawa, Kawasaki (JP); Eiji Ito, Kawasaki (JP); Takahiro Takamori, Kawasaki (JP); Noriaki Setoguchi, Higashimorokata (JP)

(73) Assignee: Fujitsu Hitachi Plasma Display Limited, Kawasaki (JP)

( * ) Notice: Subject to any disclaimer, the term of this patent is extended or adjusted under 35 U.S.C. 154(b) by 43 days.

(21) Appl. No.: 09/962,367

(22) Filed: Sep. 26, 2001

(65) Prior Publication Data

US 2002/0047578 A1 Apr. 25, 2002

(30) Foreign Application Priority Data

Sep. 29, 2000 (JP) ..... 2000-301080

(51) Int. Cl.[7] ..... G09G 3/28
(52) U.S. Cl. ..... 345/60; 345/63; 315/169.4
(58) Field of Search ..... 315/169.1, 169.2, 315/169.3, 169.4; 345/60, 63, 67, 68, 208, 209, 210, 690, 691, 693

(56) References Cited

U.S. PATENT DOCUMENTS 6,342,874 B1 * 1/2002 Tokunaga et al. ..... 345/68
6,414,658 B1 * 7/2002 Tokunaga ..... 345/63
6,707,436 B2 * 3/2004 Setoguchi et al. ..... 345/60
6,707,438 B1 * 3/2004 Ishizuka et al. ..... 315/169.3

FOREIGN PATENT DOCUMENTS

| | | |
|---|---|---|
| EP | 0 762 373 | 3/1997 |
| JP | 4-002029 | 1/1992 |
| JP | 8-306318 | 11/1996 |

OTHER PUBLICATIONS

Lawrence E. Tannas, Jr. Flat–Panel Displays and CRTs, 1985. Van Nostrand Reinhold company. Page 374.*

* cited by examiner

*Primary Examiner*—Wilson Lee
(74) *Attorney, Agent, or Firm*—Staas & Halsey LLP

(57) ABSTRACT

The plasma display apparatus, in which the light emission efficiency is improved, has been disclosed. The fourth electrodes, which extend in the same direction of the first electrodes (X electrode) and the second electrodes (Y electrodes) and are exposed into the discharge space, are provided between the first and the second electrodes where the sustaining discharge is carried out, and when the sustain action is carried out, the fixed voltage between the voltage applied to the first electrode and that applied to the second electrode is applied to the fourth electrode provided between the first and the second electrodes where the sustain action is carried out in order to make the electric field between the first and the second electrodes uniform.

14 Claims, 5 Drawing Sheets

ODD FIELD

EVEN FIELD

PLASMA DISPLAY APPARATUS

BACKGROUND OF THE INVENTION

The present invention relates to a plasma display apparatus (PDP apparatus). More particularly, the present invention relates to a plasma display apparatus using a new method and having a fourth electrode that is exposed into a discharge space extending in the same direction of that of plural first and second electrodes.

The plasma display panel has good visibility because it generates its own light, is thin and can be made with a large-screen and high-speed display. Therefore, it is attracting interest as a replacement for a CRT display. In a general PDP apparatus, n X electrodes and n Y electrodes are arranged adjacently by turns to form n pairs of X electrodes and Y electrodes, and m address electrodes are arranged in a direction perpendicular to that of the X electrodes and the Y electrodes. After a reset action, in which the entire surface is put into the same state, is carried out, a scanning pulse is applied to the Y electrode. In synchronization with the application of the scanning pulse, a signal (data signal) indicating whether to light or not is applied to the Y electrode, a display cell that is made to emit light is selected in a way that a display cell is set to a status according to the display data, and charges needed for the subsequent sustaining discharge are accumulated onto the dielectric layer on the electrode. The above-mentioned action is carried out while a scanning pulse is being applied sequentially to the Y electrode, and all the display cells on the entire surface of the screen are set to a state corresponding to the display data. This is the address action. In this state, a sustaining pulse is applied between the X electrode and the Y electrode. While a display cell, on the surface of which charges (called wall charge) are accumulated in the address action, discharges and emits light because the voltage due to these charges is superposed on the sustaining pulse, a display cell, on the surface of which no charge is accumulated, does not emit light even though the sustaining pulse is applied because the threshold of discharge is not reached. This action is called the sustain action and the discharge caused to occur by this action is called the sustaining discharge, which has a relation to the light emission for display. The display is established by repeating the above-mentioned action. The X electrodes and Y electrodes are called the display electrodes.

In the PDP apparatus of a normal type mentioned above, light is emitted for display between the X electrode and the Y electrode of each pair, therefore, n pairs of the X electrode and the Y electrode are necessary to form n display lines. In other words, 2n display electrodes (Y electrode and X electrode) are necessary to form n display lines.

On the other hand, a plasma display apparatus of the Alternate Lighting of Surface (referred to as ALIS hereinafter) method has been disclosed, in which light is emitted for display between every display electrode, in EP 0 762 373 A2. Because the detailed structure of the ALIS method has been disclosed in this Patent, no detailed explanation is provided here.

SUMMARY OF THE INVENTION

In the PDP apparatus of normal type and the PDP apparatus of ALIS method, improvement of the light emission efficiency is required for a display of a higher brightness. The first object of the present invention is to realize a new structure that will improve the light emission efficiency.

Although it is known that the light emission efficiency is improved by increasing the physical distance between each display electrode, the voltage of a sustaining pulse needs to be raised when the physical distance between each display electrode is increased because the discharge start voltage is raised accordingly. If, however, the voltage of a sustaining pulse is raised, a problem that the possibility of occurrence of the inverse slit discharge, which is described later and in which a display cell that is not required to emit light discharges, is increased, occurs.

On the other hand, it is required that the sustaining discharge is caused to occur without fail in the PDP apparatus, therefore, the sustaining discharge is made to occur without fail in the sustain action by raising the voltage of sustaining pulse and at the same time by widening the width of the first pulse, as described above. Raising the voltage of sustaining pulse, however, brings forth the above-mentioned problem, and widening the width of the first pulse also brings forth another problem that the time required for the sustain action is increased accordingly. Therefore, a structure, in which the sustaining discharge occurs without fail, is required and particularly a structure, in which the sustaining discharge is made surely to occur without increment of the voltage of sustaining pulse even when the physical distance between each display electrode is increased, is required. The second object of the present invention is to realize a new structure in which the sustaining discharge is made to occur without fail.

Moreover, in the reset action, a discharge for the reset action is made to occur without fail by increasing the voltage and width of the reset pulse to be applied to the X electrode. Raising the voltage of reset pulse, however, brings forth a problem that the contrast is degraded due to the increment in the intensity of the discharge, which has no relation to the display, because the discharge caused by the reset pulse has no relation to the display. In addition, if the width of the first pulse of the reset or sustaining pulse is widened, a problem that the time required for reset is accordingly increased, is brought forth. Therefore, another method to cause a discharge to occur without fail in the reset action is required. The third object of the present invention is to realize a structure in which a discharge is caused to occur without fail in the reset action.

Also in the conventional reset action, charges are neutralized over the entire surface of the panel in order to prevent distribution of charges on the dialectic layer on the electrode. It is possible, however, to leave a certain amount of charges uniformly over the entire surface to make the subsequent address action easier. Therefore, a simple reset action, which can be controlled so as to leave a desired amount of charges, is required. The fourth object of the present invention is to realize a structure, of a simple reset operation, which can be controlled so as to leave a desired amount of charges.

In addition, in the PDP apparatus of a normal type, a sustaining discharge is caused to occur only between one side of the Y electrode and the X electrode, and a sustaining discharge is prevented from occurring between the other side of the Y electrode and the contiguous X electrode (inverse slit) by widening the space between them. The sustaining discharge that occurs in the inverse slit is called the invert slit discharge. Moreover, in the PDP apparatus of a normal type, a light blocking film is provided between the other side of the Y electrode and the contiguous X electrode so that the display is not influenced even if the invert slit discharge occurs. If, however, the invert slit is widened, the ratio of an area that has no relation to the display is increased and this is not acceptable from the viewpoint of the higher definition of the PDP apparatus. The fifth object of the present invention is to realize a structure in which the occurrence of the invert slit discharge is suppressed.

In order to realize the above-mentioned first through fifth objects, the plasma display of the present invention is characterized in that plural fourth electrodes that are exposed into the discharge space extending in the same direction of the first electrode (X electrode) and the second electrode (Y electrode). The location of the fourth electrode and the voltage applied to the fourth electrode differ according to the object to be realized or the method employed in the PDP apparatus.

In order to realize the above-mentioned first and second objects, for example, the fourth electrode is arranged between the first and the second electrodes where the sustaining discharge occurs. In order to realize the first object, a fixed voltage, between that applied to the first electrode and that applied to the second electrode, is applied to the fourth electrode, arranged between the first and the second electrodes where the sustaining action is carried out so that the electric field between the first and the second electrodes becomes uniform. This improves the light emission efficiency. In this case, the fourth electrode works as a grid.

In order to realize the second object, a pulse that will facilitate the initiation of discharge is applied to the fourth electrode arranged between the first and the second electrodes where the sustaining action is carried out, when the first alternative pulse is applied in the sustain action. This pulse causes the trigger discharge to occur and discharge is carried out without fail thereafter.

It is possible to merge the two structures that realize the first object and the second object, respectively. In this case, the fourth electrode is arranged between the first and the second electrodes where the sustaining discharge is carried out, and a pulse that facilitates the initiation of the discharge is applied when the first alternative pulse is applied in the sustain action, and the voltage that keeps the electric field uniform is applied to the fourth electrode thereafter.

In the PDP apparatus of normal type, it is necessary to provide the fourth electrode only between one side of the second electrode and the first electrode where the sustain action is carried out, and it is not necessary between the other side of the second electrode and the contiguous first electrode. Because the same signal is applied to every fourth electrode, the fourth electrodes are connected commonly and designed so as to be activated by a single fourth electrode drive circuit.

In the PDP apparatus of the ALIS method, it is necessary to provide the fourth electrodes both between one side of the second electrode and the first electrode, and between the other side of the second electrode and the contiguous first electrode. Moreover, the fourth electrodes are classified into the first group, the second group, the third group, and the fourth group in the order of arrangement, and the fourth electrodes in each group are designed so as to be activated independently by each one of the four fourth electrode drive circuits. When the sustain action in an odd-numbered field is performed, the above-mentioned voltage that will realize the first and the second objects is applied to the fourth electrodes in the first and the third groups, and to those in the second and the fourth groups, when the sustain action is performed in an even-numbered field.

In the PDP apparatus of the ALIS method, the distance between every X electrode and Y electrode is the same because every line of the X electrode and the Y electrode is used as the display line. Therefore, a voltage of the same polarity is applied to the X electrode and the Y electrode that form a line not used for display to prevent a discharge from occurring between them. It is, therefore, necessary to apply the same signal as that applied to the first electrode and the second electrode on both sides of the fourth electrode to the fourth electrodes in the groups other than those to which the voltage to realize the above-mentioned first and second objects is applied in the sustain action. In other words, when the sustain action is performed in the odd-numbered field, the same signal as that applied to the first and the second electrodes on both sides of the fourth electrode is applied to the fourth electrodes in the second and the fourth groups, and the same signal is applied to the fourth electrodes in the first and the third groups, when the sustain action is performed in the even-numbered field.

In order to realize the third and the fourth objects, a fixed voltage is applied between the fourth electrodes adjacent to each other to carry out the reset action. Since it is necessary to carry out the reset action on the entire surface of the panel, the fourth electrodes are arranged between every first and the second electrode in this case, and also arranged outside the outermost first or second electrode. Because a fixed voltage must be applied between every adjacent fourth electrode, the fourth electrodes are classified into two groups alternately in the order of arrangement, and the fourth electrodes in each group are driven independently by each one of the two fourth drive circuits. Because the fourth electrode is exposed, it is possible to absorb wall charges even if a narrow pulse is applied, resulting in reduction of reset time. It is also possible to adjust the amount of residual wall charges easily by controlling the voltage and the width of pulse applied to the fourth electrode.

In order to realize the fifth object, the fourth electrode is arranged in the invert slit where the sustain action is not carried out in the PDP apparatus of normal type, and a voltage is applied so as to prevent the occurrence of invert slit discharge between the first and the second electrodes in the sustain action. It is possible to connect all the fourth electrodes commonly and drive them by a single fourth electrode drive circuit.

The arrangement of the fourth electrodes and the voltage to be applied to those in order to realize each object of the present invention are described above, but it is also possible to realize plural objects simultaneously by combining each arrangement and the voltage to be applied.

BRIEF DESCRIPTION OF THE DRAWINGS

The present invention will be more clearly understood from the description as set below, with reference to the accompanying drawings, wherein.

DESCRIPTION OF THE PREFERRED EMBODIMENTS

Figure 1:
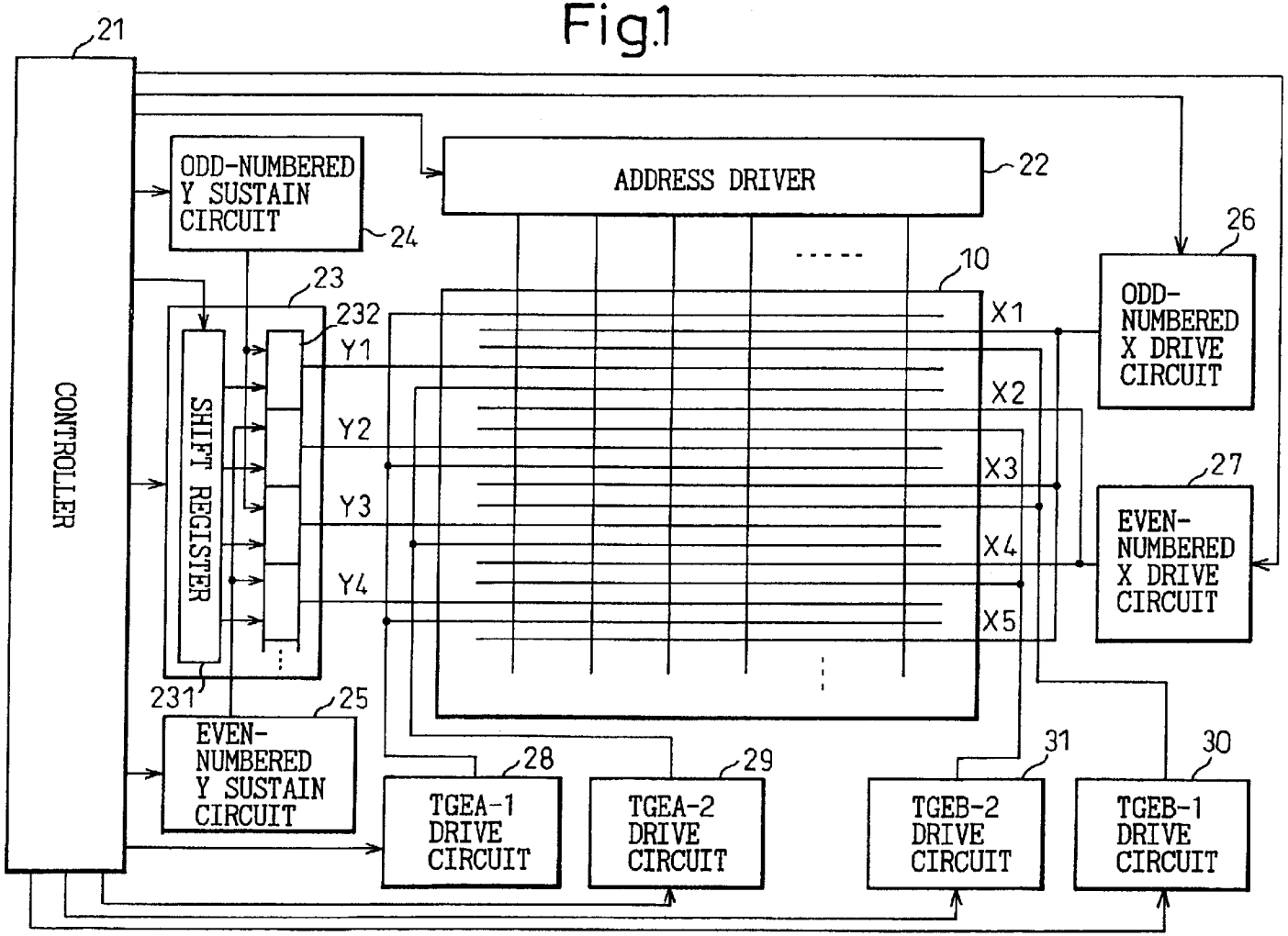
FIG. 1 is a block diagram that shows the general structure of the PDP apparatus in the first embodiment of the present invention.

FIG. 1 is a diagram that shows the general structure of the PDP apparatus in the first embodiment of the present invention. In the first embodiment, the present invention is applied to the PDP apparatus of ALIS method. Since the PDP apparatus of ALIS method has been disclosed in U.S. Pat. No. 2,801,893, therefore, no detailed description is provided here, but only the part relating to the characteristics of the present invention is described.

As shown in FIG. 1, in the plasma display panel (PDP) 10 operated by the ALIS method, n Y electrodes (the second electrodes) and (n+1) X electrodes (the first electrodes) are arranged adjacently by turns and light is emitted for display between every set of adjacent display electrodes (i.e., each set of adjacent Y electrode and X electrode). Therefore, 2n display lines are formed by (2n+1) display electrodes. In other words, in the ALIS method, a definition (i.e., resolution) twice that of the conventional PDP apparatus can be obtained with the same number of display electrodes. Moreover, the display space can be used without waste and the amount of light that is blocked by such electrodes is small and, therefore, a high opening ratio can be attained and a high brightness can be realized.

Odd-numbered X electrodes and even-numbered X electrodes are connected commonly, the odd-numbered X electrodes are driven by an odd-numbered X drive circuit 26, and the even-numbered X electrodes, by an even-numbered X drive circuit 27. The Y electrodes are driven by a Y scan driver 23. The Y scan driver 23 comprises a shift register 231 and a drive circuit 232. In an addressing action, a scan pulse generated by the shift register 231 is applied sequentially to the Y electrode by the drive circuit 232, otherwise the signal generated by an odd-numbered Y sustain circuit 24 Is applied to the odd-numbered Y electrodes, and that generated by an even-numbered Y sustain circuit 25, to the even-numbered Y electrodes. An address driver 22 applies a data signal to the address electrodes, in synchronization with the scan pulse in the address action. A controller 21 generates a control signal that controls each circuit mentioned above. The structure described above is the same as that in the conventional PDP apparatus of ALIS method.

In the PDP 10 in the first embodiment, in addition to the structure described above, the fourth electrodes (TGE electrodes) are arranged between every X electrode and Y electrode, and outside of the outermost X electrodes on both sides. The TGE electrodes extend in the same direction of X electrodes and Y electrodes, as shown schematically, and they are classified into four groups in order. That is, the nth (n is a whole number) TGE electrode belongs to the TGEA-1 electrode group, and is connected to a TGEA-1 drive circuit 28 commonly. The (n+1)th TGE electrode belongs to the TGEB-1 electrode group and is connected commonly to a TGEB-1 drive circuit 30. The (n+2)th TGE electrode belongs to the TGEA-2 electrode group, and is connected commonly to a TGEA-2 drive circuit 29. The (n+3)th TGE electrode belongs to a TGEB-2 electrode group and is connected commonly to a TGEB-2 drive circuit 31.

Figure 2A:
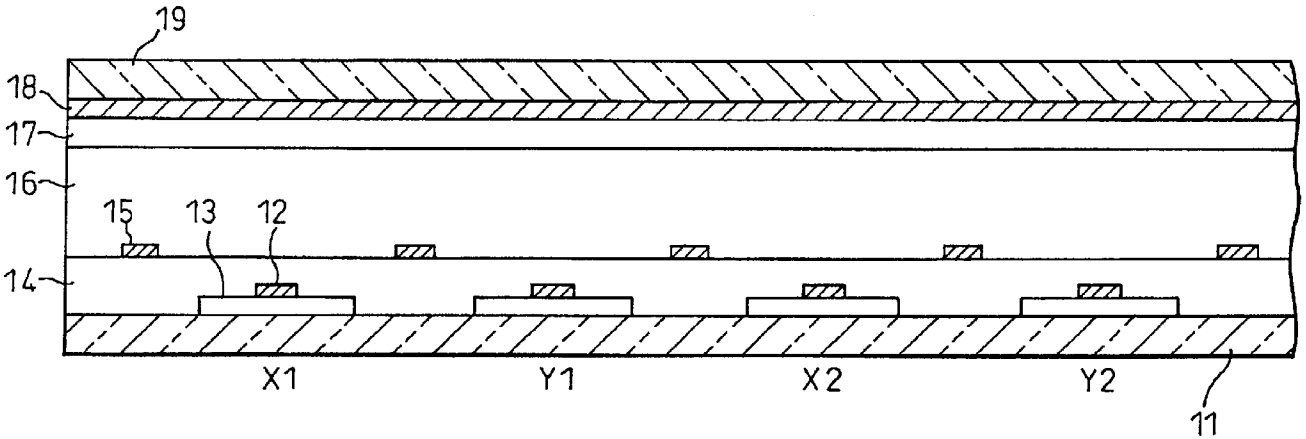
FIGS. 2A and 2B are cross sectional views of the plasma display panel in the first embodiment.
Figure 2B:
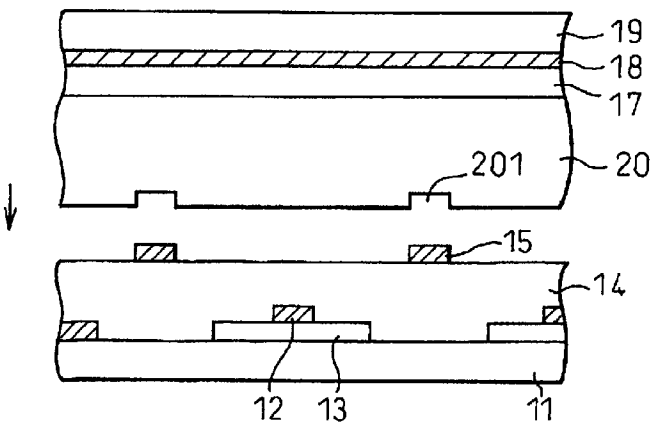

FIG. 2A is a cross sectional view of the PDP 10 in the first embodiment, and FIG. 2B is a diagram that shows how it is assembled. As shown in FIG. 2A, plural transparent electrodes 13 corresponding to X and Y electrodes and plural display electrodes consisting of metal electrodes 12 arranged thereupon are formed on a glass substrate 11, and covered by a dielectric layer 14. On the other glass substrate 19, an address electrode 18 and a dielectric layer 17 that covers the address electrode 18 are provided. The two substrates are opposing each other with a certain distance apart, and discharge gas Is enclosed in a space 16 therebetween. This space 16 is the discharge space. In the first embodiment, TGE electrodes 15 exposed to the discharge space 16 are provided at the middle between (i.e., intermediately of) pairs of adjacent display electrodes 12 on the dielectric layer 14. The TGE electrode 15 is made of metal layer.

As shown In FIG. 2B, a partitioning wall 20 is provided, aligned with and disposed at the middle of, the address electrode 18 on the dielectric layer 17 of the glass substrate 19 to prevent discharge from diffusing in the transverse direction (direction in which X and Y electrodes extend). In the conventional panel, the dielectric layer 14 has a flat surface and is arranged so that the partitioning wall 20 comes into contact with the surface of the dielectric layer 14. In the first embodiment, however, because the TGE electrode 15 is provided on the surface of the dielectric layer 14, if opposed as it is, the partitioning wall 20 comes into contact with the TGE electrode 15 and a space is generated between the partitioning wall 20 and the surface of the dielectric layer 14. If such a space exists, there is possibility of the discharge diffusing in the transverse direction. Therefore, in the first embodiment, as shown in FIG. 2(*b*), a groove 201 is provided where the partitioning wall 20 crosses the TGE electrode 15 so that the partitioning wall 20 comes into contact closely with the surface of the dielectric layer 14 and the TGE electrode 15 completely, without any space left. Instead of providing the groove 201 on the partitioning wall 20, it is possible to form a groove on the surface of the dielectric layer 14 and a TGE electrode thereupon.

Figure 3:
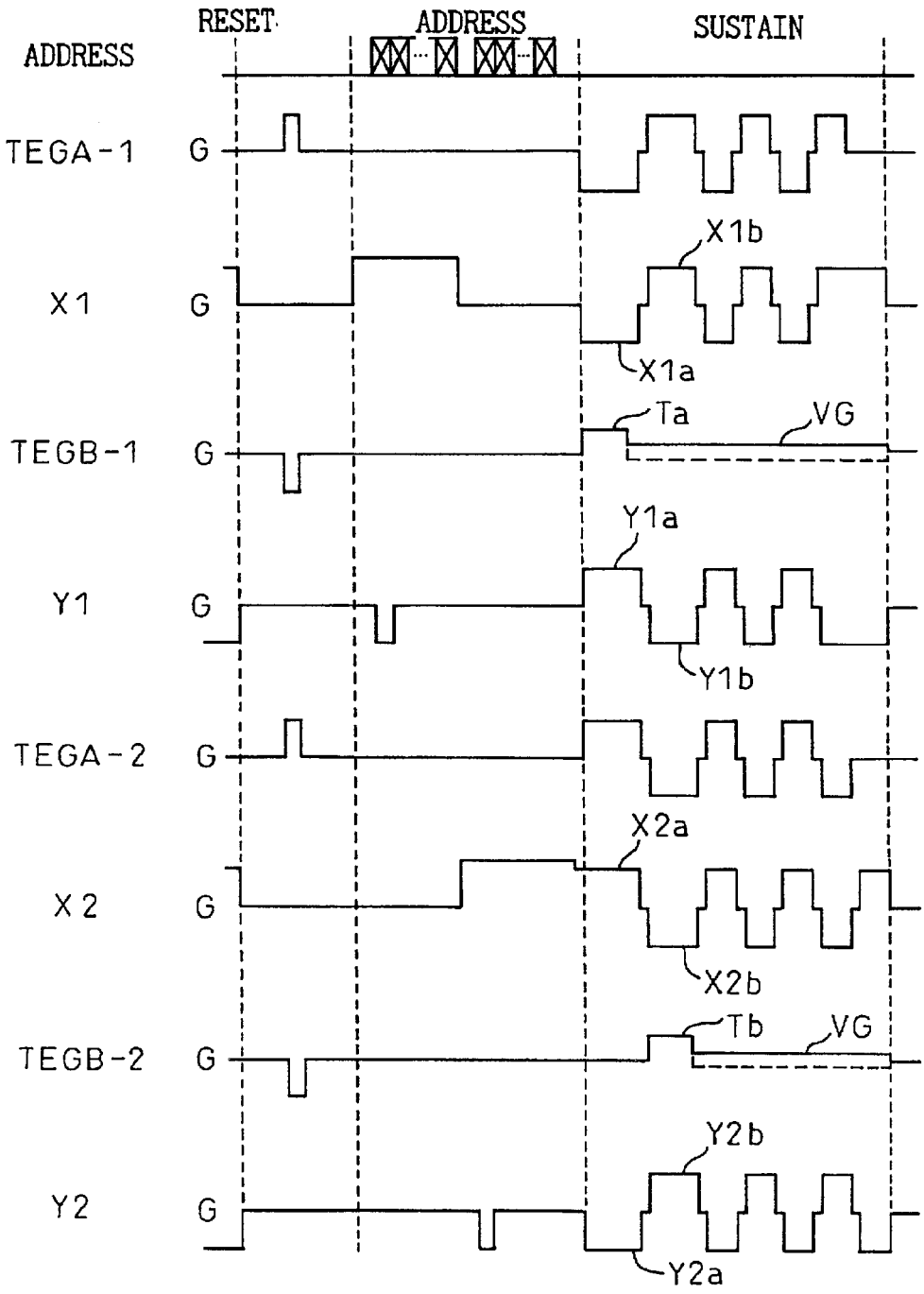
FIG. 3 is a diagram that shows the drive waveform in the odd-numbered field in the first embodiment.
Figure 4:
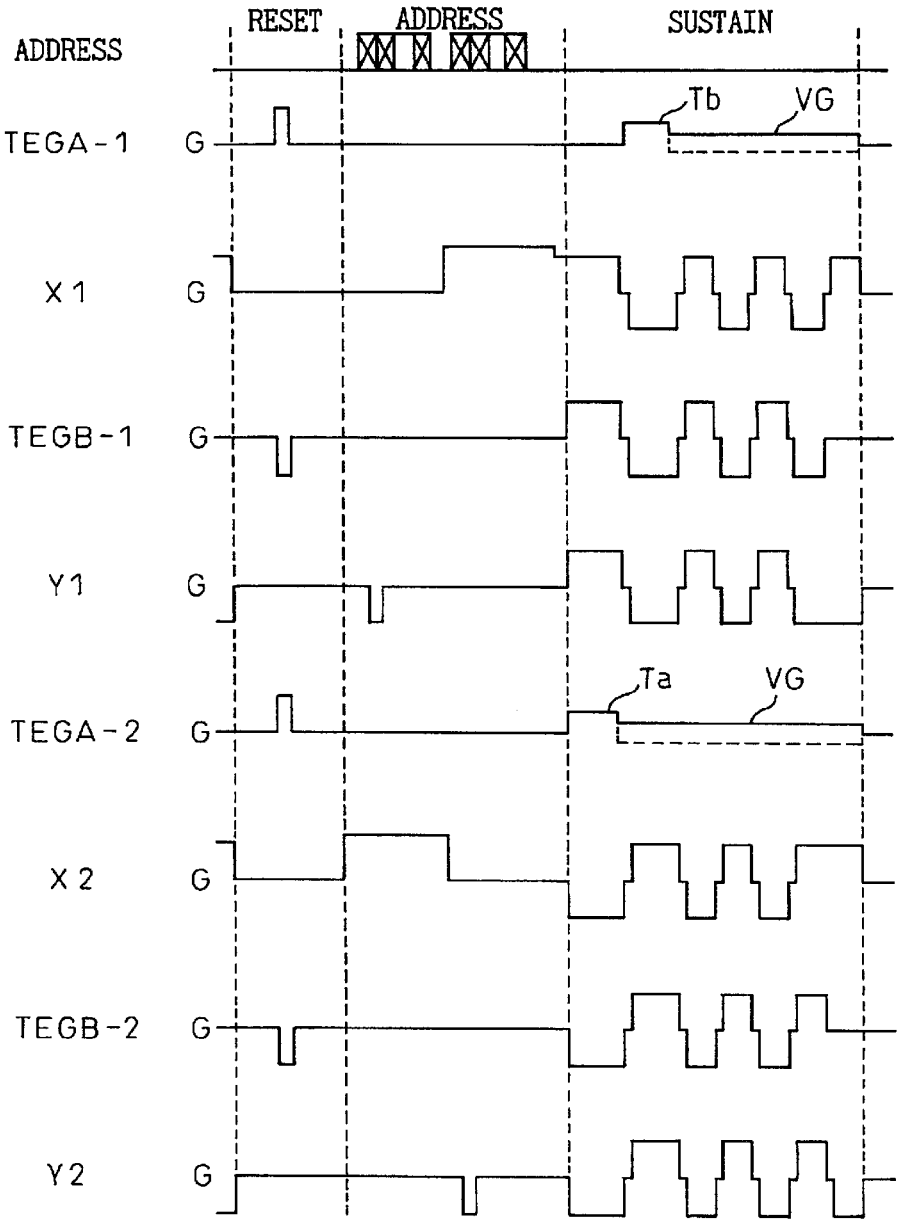
FIG. 4 is a diagram that shows the drive waveform in the even-numbered field in the first embodiment.

FIG. 3 and FIG. 4 show the drive waveform of the PDP apparatus in the first embodiment; FIG. 3 shows the waveform in the odd-numbered field and FIG. 4, that in the even-numbered field. In the PDP apparatus of ALIS method, every space between every display electrode is used for discharge for display, but it is impossible to cause those discharges to occur at the same time. Therefore, the so-called interlaced scanning is carried out in which the period for display is divided by odd-numbered lines and even-numbered lines. In the odd-numbered filed, display is established by the odd-numbered display lines and display is established by the even-numbered display lines in the even-numbered field, resulting in the total display combining the display in the odd-numbered field and that in the even-numbered field.

In the reset action, as shown in FIG. 3, after the same voltage (ground level G) is applied to the X, Y, and address electrodes, a positive pulse (approx. 150V, for example) is applied to the TGEA-1 and TGEA-2 electrodes (TGEA electrodes, in total), and a negative pulse (approx. −150V, for example) is applied to TGEB-1 and TGEB-2 electrodes (TGEB electrodes, in total), then wall charges are absorbed and eliminated in the electric field formed therebetween. The application of such a voltage between the TGEA electrode and the TGEB electrode causes a discharge to occur, but such a discharge is not necessarily required, and what is important is to absorb and eliminate the wall charges. In either way, because the wall charges are absorbed by applying a voltage between exposed electrodes in this embodiment, it is possible to eliminate the wall discharge with a discharge of small intensity or without any discharge, and a discharge that does not have relation to display can be suppressed, resulting in improvement of the contrast. It is also possible to leave a proper amount of wall charges rather than eliminating all the wall charges by adjusting the voltage and the width of the pulse applied between the TGEA electrode and the TGEB electrode. In the case in which the TGEA electrode and the TGEB electrode are used as a trigger or grid, which are described later, rather than being used to carry out reset action, the reset action can be carried out as in the conventional way, and in such a case, the TGEA electrode and the TGEB electrode are set to the ground level or a high impedance state.

In the address action, the same voltage (ground level G) is applied to the TGEA and TGEB electrodes and the same action as that in the conventional PDP apparatus of ALIS method is carried out. Therefore, a detailed description is not provided here. In such a case, it is possible not to apply a voltage to the TGEA and TGEB electrodes but set them to a high impedance state.

In the sustain action in the odd-numbered field, a sustaining discharge is carried out between an odd-numbered X electrode and Y electrode and between an even-numbered X electrode and Y electrode. Therefore, a sustaining pulse of the opposite polarity is applied to a pair of odd-numbered X electrode and even-numbered Y electrode and a pair of odd-numbered Y electrode and even-numbered X electrode. Here in the address action, negative wall charges are formed on the X electrode of the display cell that is made to emit light, and positive wall charges are formed on the Y electrode. Therefore, on the display cell that is made to emit light, the voltage due to these negative wall charges are superposed on the negative pulse X1*a* that is applied to the X1 electrode (odd-numbered X electrode), and the voltage due to these positive wall charges is superposed on the positive pulse Y1*a* that is applied to Y1 electrode (odd-numbered Y electrode), as a result, the voltage between the X1 electrode and the Y1 electrode becomes large enough to cause a sustaining discharge to occur. Concerning the X2 electrode (odd-numbered X electrode) and the Y2 electrode (even-numbered electrode), however, these wall charges work so that the influence of the pulses X2*a* and Y2*a* are reduced, resulting in no sustaining discharge. When the negative pulse X2*b* is applied to the X2 electrode and the positive pulse Y2*b* is applied to the Y2 electrode, the sustaining discharge occurs. In the present invention, the pulses to this pulse are referred to as the first pulse of the sustaining pulse. Because the wall charges move between the X1 electrode and the Y1 electrode during the first sustaining discharge, the sustaining discharge occurs when the positive pulse X1*b* is applied to the X1 electrode and the negative pulse Y1*b* is applied to the Y1 electrode. This action is the same in the case of the conventional ALIS method.

In the case of the PDP apparatus in the first embodiment, when the negative pulse X1*a* is applied to the X1 electrode, the positive pulse Y1*a* is applied to the Y1 electrode, and the first sustaining discharge is caused to occur between the X1 electrode and the Y1 electrode, the positive pulse Ta is applied to the TGEB-1 electrode therebetween. This causes the difference in voltage between the TGEB-1 electrode and the X1 electrode, on and to which the negative wall charges (electrons) are accumulated and the negative pulse X1*a* is applied, to increase, and makes a discharge occur easily and, as a result, the discharge is made to occur without fail. Once the discharge occurs, charges are formed in the discharge space and these charges serve as a trigger to cause a normal sustaining discharge to occur between the X1 electrode and the Y1 electrode. As described above, the first sustaining discharge is made surely to occur between the X1 electrode and the Y1 electrode.

In addition, when the negative pulse X2*b* is applied to the X2 electrode, the positive pulse Y2*b* is applied to the Y2 electrode, and the first sustaining discharge is caused to occur between the X2 electrode and the Y2 electrode, the positive pulse Ta is applied to the TGEB-2 electrode therebetween. This causes the difference in voltage between the TGEB-2 electrode and the X2 electrode, on and to which the negative wall charges (electrons) are accumulated and the negative pulse X2*b* is applied, to increase and makes a discharge occur easily, and as a result, the discharge is made to surely occur. Once the discharge occurs, charges are formed in the discharge space and these charges serve as a trigger to cause a normal sustaining discharge to occur between the X2 electrode and the Y2 electrode. As described above, the first sustaining discharge is made surely to occur between the X2 electrode and the Y2 electrode.

In the sustain action after the first sustaining discharge occurs, a voltage VG, which is between voltages (+80V and −80V, for example) applied to the X electrode and the Y electrode in the sustain action, is applied to the TGEB-1 and TGEB-2 electrodes. The sustaining discharge is caused to occur in the discharge space just above the TGEB-1 electrode or the TGEB-2 electrode. By applying the voltage VG to the TGEB-1 electrode or the TGEB-2 electrode, the variations of the electric field formed by the X electrode and the Y electrode on both sides are compensated, and the light emission efficiency is improved. When it is not necessary to compensate for the variations of the electric field, the voltage VG can be the ground level or a high-impedance state can be established.

Moreover, it is acceptable that the voltage VG, instead of the pulse for trigger, is applied to the TGEB-1 electrode and the TGEB-2 electrode in the sustain action, or the high-impedance state is established.

Because the sustaining pulse of the same polarity is applied to the X electrode and the Y electrode on both sides of the TGEB-1 electrode and the TGEB-2 electrode in the sustain action, the sustaining pulse of the same polarity is applied to the X electrode and the Y electrode on both sides of the TGEB-1 electrode and the TGEB-2 electrode to prevent an erroneous discharge. In addition, because the sustaining pulse of the same polarity is applied to the X electrode and the Y electrode on both sides, the discharge does not occur even if a pulse of a slightly different voltage is applied to the TGEB-1 electrode and the TGEB-2 electrode, therefore, the ground G can be applied or the high-impedance state can be established.

As shown in FIG. 4, in the reset action in the even-numbered field, similar to the odd-numbered field, after the same voltage (ground level G) is applied to the X electrode, the Y electrode, and the address electrode, a positive pulse (approx. +150V, for example) is applied to the TGEB-1 electrode and the TGEB-2 electrode (TGEA electrode in total), a negative pulse (approx. −150V, for example) is applied to the TGEB-1 electrode and the TGEB-2 electrode (TGEB electrode in total), and the wall charges are absorbed and eliminated in the electric field formed therebetween. The address action is the same except in that the selected line is different.

In the sustain action, the trigger pulses Tb and Ta are applied to the TGEB-1 electrode between the Y1 electrode (odd-numbered Y electrode) and the X2 electrode (even-numbered X electrode), and to the TGEB-2 electrode between the Y2 electrode (odd-numbered Y electrode) and the even-numbered X electrode (not shown), respectively, and then the voltage VG is applied to the TGEB-1 electrode and the TGEB-2 electrode. In addition, the sustain pulses of the same polarity are applied to the X electrodes and the Y electrodes on both sides of the TGEB-1 electrode and the TGEB-2 electrode to prevent an erroneous discharge.

Although the first embodiment, in which the present invention is applied to the PDP apparatus of ALIS method, is described above, there can be various modifications. For example, the TGEA electrode and the TGEB electrode are used to control the reset action and the sustain action in the first embodiment, but only one action can be controlled. For example, when the reset action is not carried out, it is not necessary to provide the TGEA electrode outside the outermost X electrode. Or, the voltage to be applied to the TGEA electrode and the TGEB electrode can be set adequately.

Figure 5:
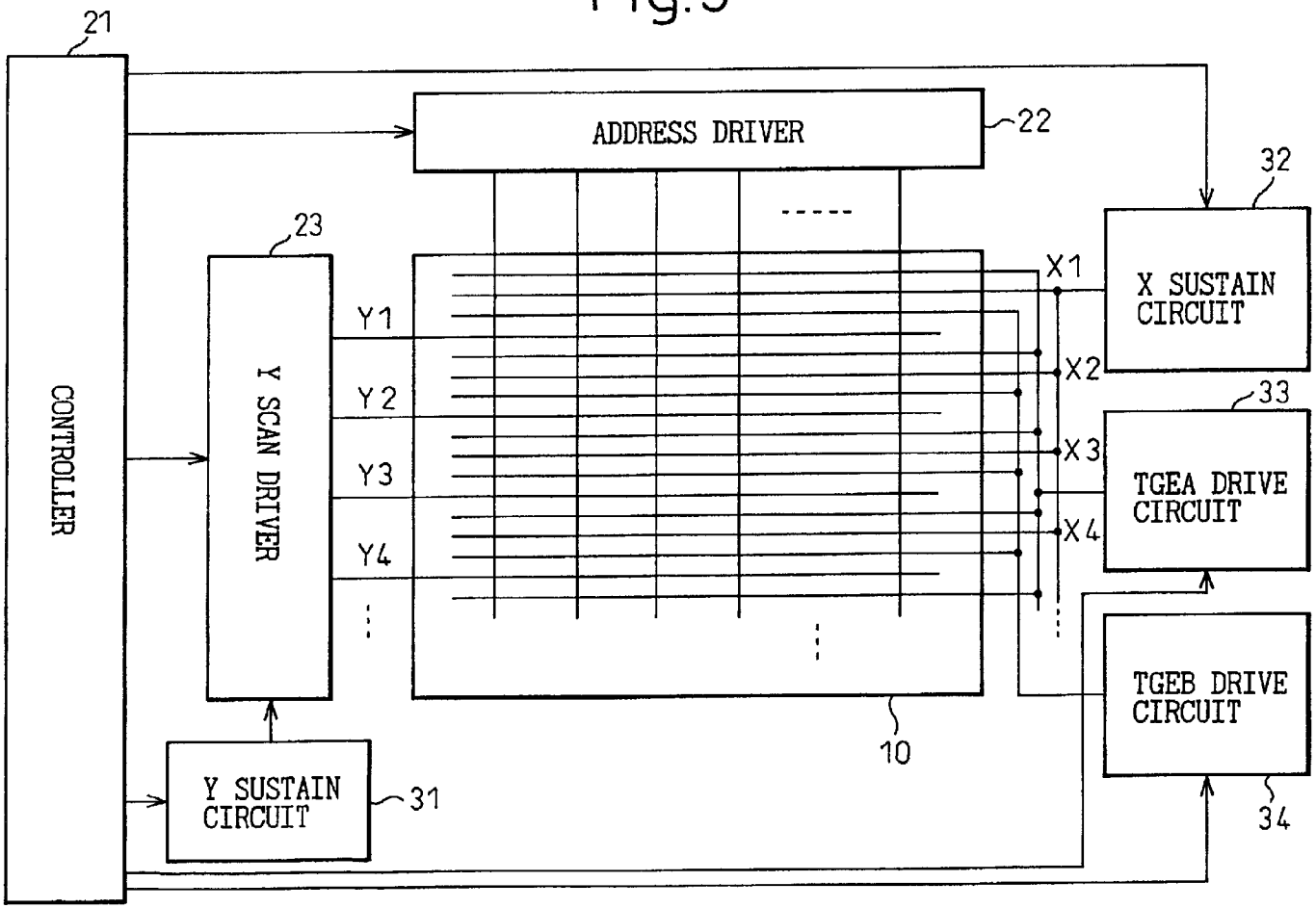
FIG. 5 is a block diagram the shows the general structure of the PDP apparatus in the second embodiment of the present invention.

Next, the second embodiment, in which the present invention is applied to the PDP apparatus of normal type, is described. FIG. 5 is a diagram that shows the structure of the PDP apparatus in the second embodiment. Because, in the PDP apparatus of normal type, all the X electrodes are connected and controlled by the X sustain circuit 32 commonly, the control circuit 21, the address driver 22, the Y scan driver 23, the Y sustain circuit 31, and the X sustain circuit 32 are the same as those in the conventional examples. The panel 10 of the PDP apparatus in the second embodiment has the TGE electrodes in every space between each X electrode and Y electrode and outside the outermost X electrode. The TGE electrode is one exposed into the discharge space similar to the first embodiment. The odd-numbered TGE electrodes are classified into the TGEA electrode group and the TGEB electrode group, and the TGEA electrode group is connected to the TGEA drive circuit 33 commonly and the TGEB electrode group is connected to the TGEB drive circuit 34 commonly. When the reset action is carried out using the TGE electrode, a pulse of the opposite polarity is applied to the TGEA electrode and the TGEB electrode. In the sustain action, a voltage is applied to the TGEB electrode to let it work as a trigger or a grid, and a voltage is applied to the TGEA electrode to prevent the invert slit discharge.

As described above, according to the present invention, in addition to the first sustain discharge being made to surely occur, the light emission efficiency is improved and the reliability of the PDP apparatus is also improved. Moreover, the time required for the reset operation can be abbreviated and a desired amount of the wall charges can be left after the reset action. This improves the contrast of the display and the reliability of the PDP apparatus.

We claim:

1. A plasma display apparatus having a discharge space, comprising:

plural first and second electrodes that are arranged adjacently and extend in a first direction;

plural third electrodes extending in a second direction, perpendicular to the first direction; and plural fourth electrodes that extend in the first direction and are exposed to the discharge space, wherein:

when a sustain action is carried out, a voltage, between a voltage applied to said first electrode and a voltage applied to said second electrode, is applied to said fourth electrode disposed between said first and second electrodes where said sustain action is carried out.

2. A plasma display as set forth in claim 1, wherein, the voltage to be applied to said fourth electrode in said sustain action can be set so as to make the electric field between said first and second electrodes uniform.

3. A plasma display apparatus having a discharge space, comprising:

plural first and second electrodes that are arranged adjacently and extend in a first direction;

plural third electrodes extending in a second direction perpendicular to the first direction; and plural fourth electrodes that extend in the first direction and are exposed to the discharge space, wherein:

when a first pulse of an alternating current is applied in a sustain action, a pulse is applied to said fourth electrode, provided between said first and second electrodes where said sustain action is carried out, in order to make the initiation of a discharge easier.

4. A plasma display apparatus having a discharge space, comprising:

plural first and second electrodes that are arranged adjacently and extend in a first direction;

plural third electrodes extending in a second direction perpendicular to the first direction; and plural fourth electrodes that extend in the first direction and are exposed to the discharge space, wherein:

when a sustain action is carried out, a voltage, which is applied to said fourth electrode provided between said first and the second electrodes where said sustain action is carried out, differs, when said first pulse of an alternating current is applied in said sustain action, from that thereafter.

5. A plasma display apparatus as set forth in claim 1, wherein, said plural fourth electrodes are provided between one side of said second electrode and said first electrode where said sustain action is carried out, connected commonly, and driven by a single fourth drive circuit.

6. A plasma display apparatus as set forth in claim 2, wherein, said plural fourth electrodes are provided between one side of said second electrode and said first electrode where said sustain action is carried out, connected commonly, and driven by a single fourth drive circuit.

7. A plasma display apparatus as set forth in claim 3, wherein, said plural fourth electrodes are provided between one side of said second electrode and said first electrode where said sustain action is carried out, connected commonly, and driven by a single fourth drive circuit.

8. A plasma display apparatus as set forth in claim 4, wherein, said plural fourth electrodes are provided between one side of said second electrode and said first electrode where said sustain action is carried out, connected commonly, and driven by a single fourth drive circuit.

9. A plasma display apparatus having a discharge space, comprising:

plural first and second electrodes that are arranged adjacently and extend in a first direction;

plural third electrodes extending in a second direction perpendicular to the first direction; and plural fourth electrodes that extend in the first direction and are exposed to the discharge space, wherein:

a first display line is formed between one side of said second electrode and said first electrode contiguous thereto, and a second display line is formed between the other side of said second electrode and said first electrode contiguous thereto;

display of a frame is performed by an odd-numbered field that is established by said first display line and an even-numbered field that is established by said second display line;

said plural fourth electrodes are provided between both sides of said second electrodes and said first electrode, and classified into a first group, a second group, a third group, and a fourth group, in that order;

four fourth electrode drive circuits that drive said fourth electrodes in each group independently are provided; and when a sustain action in said odd-numbered field is carried out, a voltage is applied to said fourth electrodes in said first and third groups, and when said sustain action in said even-numbered field is carried out, said voltage is applied to said fourth electrodes in said second and fourth groups.

10. A plasma display apparatus as set forth in claim 9, wherein, when said sustain action in said odd-numbered field is carried out, same signal as that applied to said first and second electrodes on both sides of said fourth electrode is applied to said fourth electrodes in said second and fourth groups, and when said sustain action in said even-numbered field is carried out, same signal as that applied to said first and second electrodes on both sides of said fourth electrodes is applied to said fourth electrodes in said first and third groups.

11. A plasma display apparatus having a discharge space, comprising:

plural first and second electrodes that are arranged adjacently and extend in a first direction and plural third electrodes that extend in a second direction perpendicular to the first direction, wherein:

after a reset action that sets all the cells to an initial state, an address discharge is selectively caused to occur in a cell for display by applying a voltage selectively to each third electrode, while applying a scanning pulse sequentially to said plural second electrodes to perform an address action that selects a cell for display, an alternating current is applied to said first electrode and said second electrode to perform a sustain action that selectively causes a sustain discharge to occur in the cell selected in said address action, and said reset action, said address action, and said sustain action are carried out repeatedly, and plural fourth electrodes that extend in said first direction and are exposed to said discharge space where said sustain discharge is performed are provided, and said reset action is carried out by applying a pulse with a voltage difference between adjacent electrodes of said plural fourth electrodes.

12. A plasma display apparatus having a discharge space, comprising:

plural first and second electrodes that are arranged adjacently and extend in a first direction, plural third electrodes extending in a second direction perpendicular to the first direction, and plural fourth electrodes that extend in the first direction and are exposed to the discharge space, wherein:

said plural fourth electrodes are provided in a space between said first and second electrodes and also outside of first and/or second outermost electrodes;

said plural fourth electrodes are classified into two groups in the order of arrangement by turns; and two fourth electrode drive circuits that drive said fourth electrodes in each group are independently provided.

13. A plasma display apparatus, comprising:

plural first and second electrodes that are arranged adjacently and extend in a first direction, plural third electrodes extending in a second direction perpendicular to the first direction, and plural fourth electrodes that extend in the first direction and are exposed to the discharge space wherein:

a sustain action is carried out between one side of said second electrode and said first electrode;

said plural fourth electrodes are provided between another side of said second electrode and said first electrode, where said sustain action is not carried out, and are connected commonly; and a voltage is applied by a drive circuit to drive said plural fourth electrodes and to prevent a discharge from occurring between said another side of the second electrode and said first electrode in said sustain action.

14. A plasma display apparatus having a discharge space, comprising:

plural first and second electrodes arranged adjacently and extending in a first direction on a first substrate and covered by a first dielectric layer, a sustaining discharge occurring between adjacent said first and second electrodes in response to respective first and second sustain voltages being applied thereto;

plural third electrodes formed on a second substrate, the second substrate being spaced from the first substrate and defining a discharge gap therebetween, and the plural third electrodes extending in a second direction, perpendicular to the first direction, and being covered by a second dielectric layer, and plural fourth electrodes formed on the first dielectric layer, extending in the first direction and exposed to the discharge space, each fourth electrode being disposed between a pair of corresponding first and second electrodes, wherein:

when a sustain action is carried out, a voltage, of a level between respective voltage levels of the first and second sustain voltages, is applied to each said fourth electrode disposed between said corresponding pair of first and second electrodes to facilitate initiating a sustain discharge therebetween.

* * * * *

UNITED STATES PATENT AND TRADEMARK OFFICE

CERTIFICATE OF CORRECTION

PATENT NO. : 6,842,159 B2
DATED : January 11, 2005
INVENTOR(S) : Tomokatsu Kishi et al.

It is certified that error appears in the above-identified patent and that said Letters Patent is hereby corrected as shown below:

Column 12,
Line 36, change “layer,” to -- layer; --

Signed and Sealed this

Fourteenth Day of June, 2005

JON W. DUDAS
*Director of the United States Patent and Trademark Office*